US009053623B2

(12) United States Patent
Nguyen

(10) Patent No.: US 9,053,623 B2
(45) Date of Patent: Jun. 9, 2015

(54) SECURITY TAG FOR DELICATE ARTICLES

(71) Applicant: Tyco Fire & Security GmbH, Rheinfall (CH)

(72) Inventor: Thang Tat Nguyen, Boca Raton, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 147 days.

(21) Appl. No.: 13/901,211

(22) Filed: May 23, 2013

(65) Prior Publication Data

US 2013/0321155 A1 Dec. 5, 2013

Related U.S. Application Data

(60) Provisional application No. 61/655,158, filed on Jun. 4, 2012.

(51) Int. Cl.

| | |
|---|---|
| ***G08B 13/14*** | (2006.01) |
| ***G08B 13/24*** | (2006.01) |
| ***E05B 73/00*** | (2006.01) |

(52) U.S. Cl.

CPC ..... *G08B 13/2434* (2013.01); *Y10T 29/49826* (2013.01); *E05B 73/0017* (2013.01)

(58) Field of Classification Search

None

See application file for complete search history.

(56) References Cited

U.S. PATENT DOCUMENTS

| | | | | |
|---|---|---|---|---|
| 2004/0222890 | A1* | 11/2004 | Yang et al. | 340/572.9 |
| 2007/0096925 | A1* | 5/2007 | Yang et al. | 340/572.9 |
| 2008/0050201 | A1* | 2/2008 | Valade et al. | 411/455 |
| 2010/0001841 | A1* | 1/2010 | Cardullo | 340/10.1 |
| 2010/0007469 | A1* | 1/2010 | Cardullo | 340/10.1 |
| 2010/0058629 | A1* | 3/2010 | Albee et al. | 40/301 |

* cited by examiner

*Primary Examiner* — Travis Hunnings

(74) *Attorney, Agent, or Firm* — Alan M. Weisberg; Christopher & Weisberg, P.A.

(57) ABSTRACT

A security tag is configured to releasably attach to an article. The security tag includes a tack in which the tack includes a tack head and a pin shank extending from the tack head. The pin shank has a maximum diameter less than 0.9 millimeters. The security tag further includes a housing in which the housing includes an electronic article surveillance (EAS) element. The housing further includes a clutch that is configured to releasably retain the pin shank after insertion into the housing. The clutch retaining the pin shank if up to an eighty pound pull force is applied to the tack.

20 Claims, 8 Drawing Sheets

SECURITY TAG FOR DELICATE ARTICLES

CROSS-REFERENCE TO RELATED APPLICATION

This application is related to and claims priority to U.S. Provisional Patent Application Ser. No. 61/655,158, filed Jun. 4, 2012, entitled SECURITY TAG FOR DELICATE APPAREL, the entirety of which is incorporated herein by reference.

STATEMENT REGARDING FEDERALLY SPONSORED RESEARCH OR DEVELOPMENT n/a

FIELD OF THE INVENTION

The present invention relates to electronic article surveillance ("EAS") and in particular to a method and system for security tags.

BACKGROUND OF THE INVENTION

Electronic Article Surveillance ("EAS") systems are often incorporated in retail settings to protect item or articles from unauthorized removal. These EAS system may include a monitoring system and one or more security tags or labels in which the monitoring system establishes a surveillance or interrogation zone, usually at an access point for the controlled area. Articles which are authorized for removal from the area can have the tag deactivated or removed at checkout so as not be detectable by the monitoring system. However, if the monitored item enters the surveillance zone with an active security tag, an alarm may be triggered to indicate possible unauthorized removal of the item.

EAS tags or labels can be constructed in several different configurations that are often dictated by the nature of the article to be protected. For example, pre-packaged goods which are subject to retail theft, such as CDs, DVDs, small electronic devices, etc., may contain an EAS label disposed within the packaging in such a way that it is hidden from the consumer, at least during the pre-purchase period. For user wearable items such as clothing, the EAS label may be enclosed in a rigid housing that can be removably secured to article 20 as illustrated in FIG. 1. This configuration is referred to as system 10 that includes EAS hard tag 12 and tack 14 with pin 16 that is inserted through the fabric of the clothing article 20 and secured in place on the opposite side of the fabric with locking mechanism 18. The housing cannot be removed from the clothing without destroying the housing except by using an EAS deactivator or detacher.

Tack 14 typically includes a pin 16 and tack head in which the pin 16 engages with locking mechanism 18 to releasably secure tack 14. More importantly, EAS tags 12 uses pin 16 having a diameter of 1.2 millimeters (0.047 inches) or larger. This 1.2 mm diameter pin size has been used since the inception of the EAS hard tag industry to the present in which the 1.2 mm pin diameter has become the standard size pin for the hard tag industry. Pin 16 of tack 14 is maintained within the tag body 12 by a receiving and locking mechanism 18. One type of locking mechanism 18 is a spring clamp arrangement in which groves in pin 16 (not shown) engage the spring clamp mechanism to releasable lock tack 14 in place.

However, due to the groves notched into the pin 16, pin 16's diameter cannot be less than 1.2 mm as the notches would create a fragile breaking point in a smaller diameter sized pin that can easily be defeated by a thief, i.e., a smaller diameter pin would break at the notches and would not be able to withstand an eighty pound pull force. Another clutch used in EAS hard tags is a magnetic ball-clutch arrangement in which groove-less pin 16 is releasably engaged by a configuration of balls such that tack 14 is substantially prevented from being removed from the tag. The ball-clutch arrangement of known devices requires a pin diameter of at least 0.9 mm and balls having a diameter 2.5 mm in order to be able to withstand an eighty pound pull force. If the diameter of pin 16 was made smaller the ball-clutch would not be able to properly grasp pin 16 such that a thief could easily pull out tack 14 without a security tag detacher, thereby rendering the security tag useless.

One problem with the standard 1.2 mm diameter pin size is that it is too large for many applications. Retailers consider the standard size 1.2 mm pin to be unacceptable for use on items such as leather, vinyl and or finely-woven and/or delicate materials. For example, when the 1.2 mm diameter pin is inserted through the item, the item incurs some damage from pin 16. Pin 16 being inserted and removed from a more coarsely-woven fabric will not result in substantially visible damage; however, with finely-woven or solid materials, the standard size pin diameter of 1.2 mm will leave a permanent and very visible hole in the fabric. Similarly, insertion of a 1.2 mm diameter pin through leather will permanently damage the item with a noticeable pin hole. This damage to article 20 which may be incurred due to the attached theft deterrent device is unacceptable to customers at the point of sale.

Another problem with EAS hard tags is that attachment of the tag via pin 16 to delicate materials such as silk, satin-woven and sheer fabrics can result in the materials being torn by pin 16 during routine handling of the item. When existing hard tags are attached to smaller, delicate item such as lingerie the size and weight of the tag relative to the item results in pin 16 working against the fabric. In other words, while the tag is attached to the fabric via pin 16, handling of the item typically pushes and pulls the fabric making the pin hole larger, often leaving the fabric with a noticeable hole greater than the 1.2 mm diameter of pin 16. Furthermore, a grooved pin that is required by many tack-retaining clutch systems also tends to snag and tear delicate fabrics as the fabrics get caught in the notches of pin 16.

Yet another problem with the prior art hard tags is that there is no one type of EAS hard tag solution which works on all types of shoes. This is because the current standard pin diameter of 1.2 mm is considered too large for shoes due to the fact that piercing the leather with the 1.2 mm pin results in a large and very visible hole in the leather. Therefore, retail stores will often choose a different and often more expensive hard tag specifically made for protecting shoes but that likely cannot be re-used to protect other types of items such as clothing.

SUMMARY OF THE INVENTION

The present invention advantageously provides a method and system for electronic article surveillance ("EAS") and in particular provides a security tag that causes less pin hole damage to an article than existing security tags. According to one embodiment, a security tag is configured to releasably attach to an article. The security tag includes a tack in which the tack includes a tack head and a pin shank extending from the tack head. The pin shank has a maximum diameter less than 0.9 millimeters. The security tag further includes a housing in which the housing includes an electronic article surveillance (EAS) element. The housing further includes a clutch that is configured to releasably retain the pin shank after insertion into the housing. The clutch retaining the pin shank if up to an eighty pound pull force is applied to the tack.

According to another embodiment, a security tag is configured to releasably attach to an article. The security tag includes a tack in which the tack includes a tack head. The tack head includes a tack mating surface in which at least a portion of the tack mating surface has at least one of a textured surface and a substantially non-slip surface. The security tag further includes a pin shank in which the pin shank extends substantially orthogonally from the tack mating surface. The security tag further includes a housing in which the housing includes an electronic article surveillance (EAS) element. The housing further includes a clutch. The clutch is configured to releasably retain the pin shank. The housing further includes a housing mating surface that substantially faces the tack mating surface if the pin shank is releasably retained by the clutch.

According to another embodiment, a method of attaching a security tag to an article is provided. The security tag includes a tack and a housing. The tack has a tack head and a pin shank extending from the tack head. The pin shank has a maximum diameter of less than 0.9 millimeters and the housing includes a ball clutch configured to releasably retain the pin shank if the pin shank is inserted into the housing. The housing further includes an electronic article surveillance (EAS) element configured to emit a detectable response if introduced to an interrogation signal. The pin shank is inserted through the article. The pin shank is inserted into the housing in which the ball clutch is configured to releasably retain the inserted pin shank if up to an eighty pound pull force is applied to the tack.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
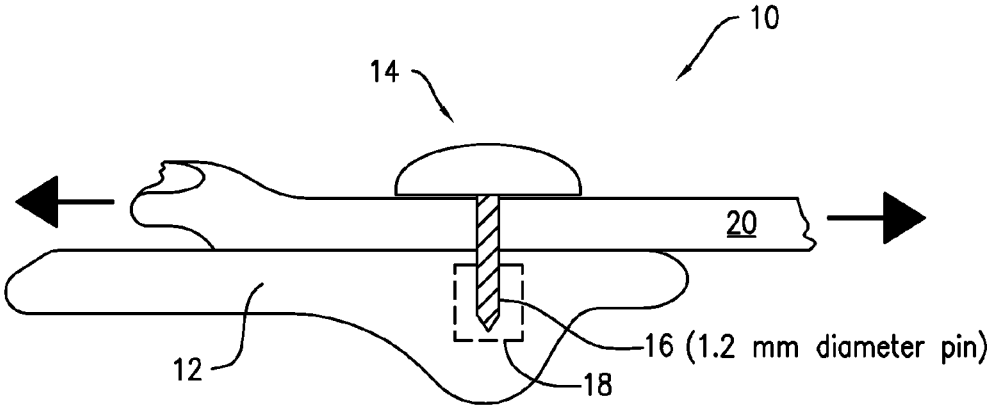
FIG. 1 (Prior Art)
FIG. 1 illustrates a side view of an existing security tag system with a 1.2 mm diameter pin.

The present invention advantageously provides a system, method and security tag for electronic article surveillance ("EAS"). Accordingly, the system, device and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

Figure 2:
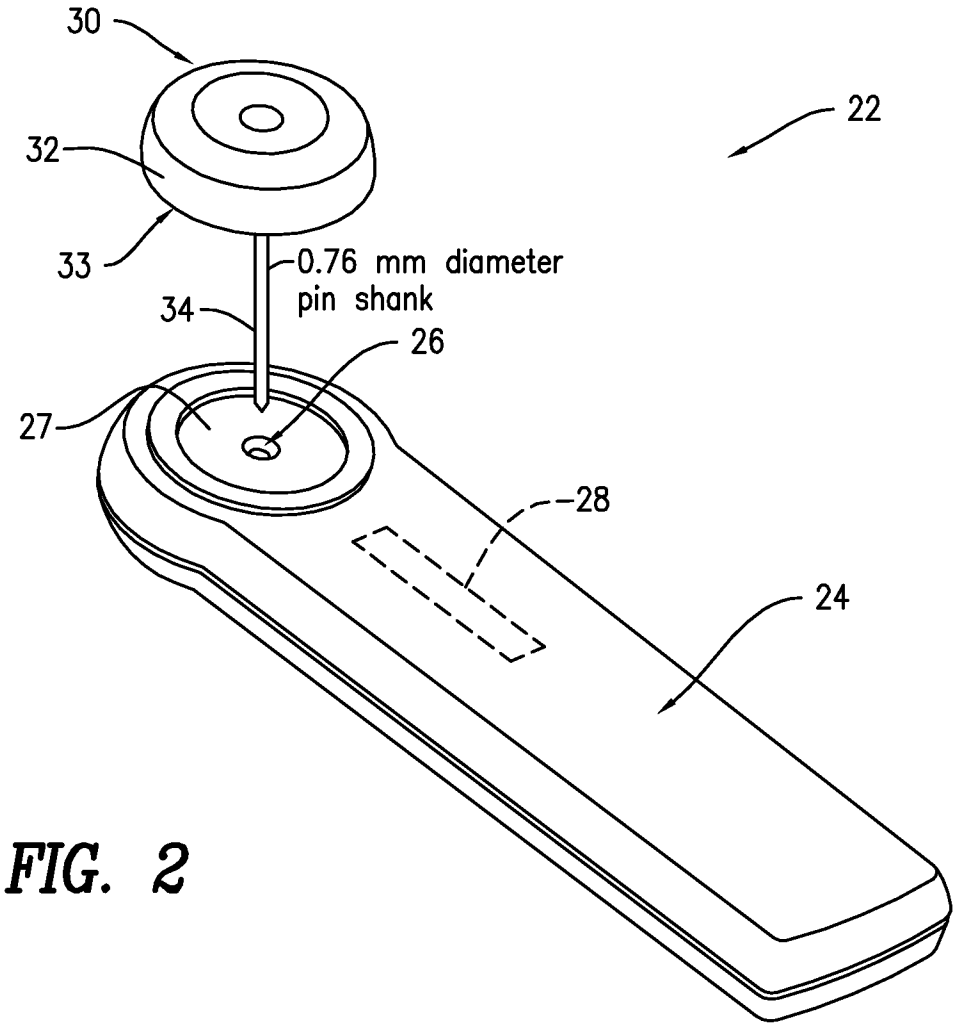
FIG. 2 illustrates a perspective view of a security tag system constructed in accordance with the principles of the present invention.

Referring now to the drawing figures in which like reference designators refer to like elements there is shown in FIG. 2 a top perspective view of an exemplary security tag constructed in accordance with the principles of the present invention and designated generally as "22." Tag 22 includes tag housing 24 that may be made of semi-hard or rigid material. For example, tag housing 24 may be made out of hard plastic such as an injection molded Acrylonitrate-Butadiene-Styrene (ABS) plastic, or a plastic such as polycarbonate. If plastic material is used to form tag housing 24, the housing can be assembled using an ultrasonic weld, snap fitting or any other joining arrangements.

Tag housing 24 includes aperture 26 proximate locking clutch 36 (not shown) and housing mating surface 27. In one embodiment, housing mating surface 27 is a textured surface that helps reduce or substantially prevent article 20 from sliding if article 20 is sandwiched between tag housing 24 and releasably retained tack 30. Tag housing 24 further includes EAS element 28 that emits a detectable and/or audible signal when introduced to an interrogation signal. The detectable signal can be detected by EAS interrogation systems, e.g., EAS pedestal systems. EAS element 28 may be a magnetic sensor, acousto-magnetic sensor, radio frequency sensor, or other type of sensor capable of emitting a detectable signal if introduced to an EAS interrogation signal. EAS element 28 may be active, i.e., powered by a battery or other power source, or passive. The interior of tag hosing 24 includes a locking clutch (not shown) configured to releasably retain tack 26 that is inserted through aperture 26 as discussed in detail with respect to FIG. 3.

Tag 22 includes tack 30 having tack head 32 and pin shank 34 extending orthogonally from tack head 32. Tack head 32 may be formed using plastic and/or steel. Tack head 32 includes tack mating surface 33 that faces and overlaps at least a portion of housing mating surface 27 when pin shank 34 is releasably retained by locking clutch 36. In one embodiment, tack mating surface 33 may be textured such as to reduce or substantially prevent article 20 from sliding if article 20 is sandwiched between tag housing 24 and releasably retained tack 30.

Pin shank 34 is configured to be removably inserted into aperture 26. Pin shank 34 is non-grooved and has a maximum diameter of less than 0.9 millimeters. In one embodiment, pin shank 34 has a maximum diameter of 0.76 millimeters. The substantially reduced pin diameter of the present invention, namely, 0.76 millimeters, advantageously reduces the damage or size of the piercing hole caused by pin shank 34 while still allowing locking clutch 36 to releasably retain pin shank 34 if an eighty pound pull force is applied to tack 30. In other words, the instant invention provides the article protection benefits of existing EAS systems while reducing the pin hole damage to article 20. Pin shank 34 may be formed using steel. Pin shank 34 may be hardened to Rockwell RC 35-50. In one embodiment, tack head 32 and metal pin shank 34 may be manufactured as a unitary metal piece or can be assembled from a plastic tack head and metal pin shank.

Figure 3:
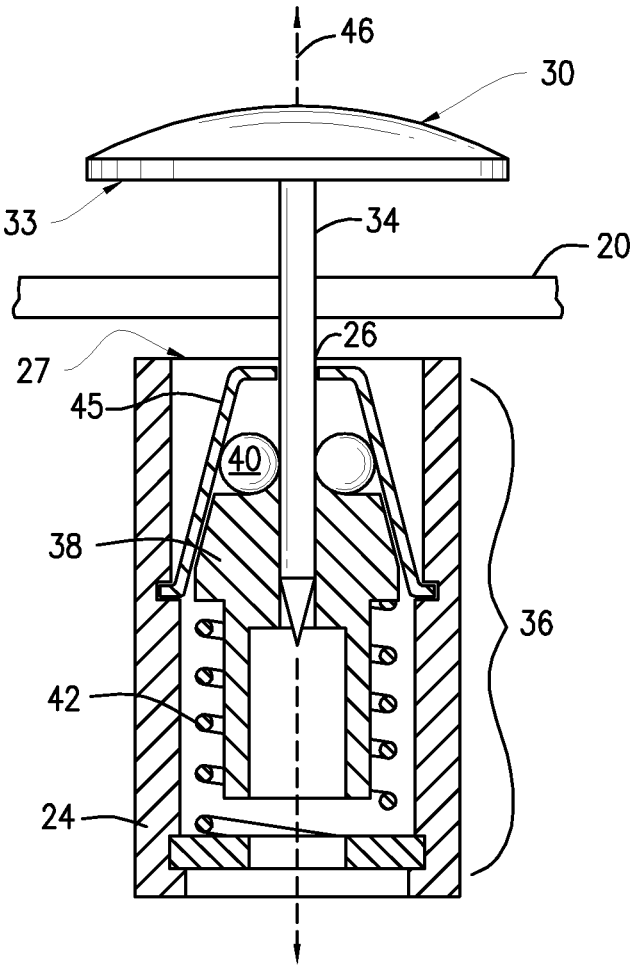
FIG. 3 illustrates a cross-section view of a portion of the security tag system of FIG. 2 constructed in accordance with the principles of the present invention.

FIG. 3 is a cross-section view of a portion of tag 22. Tag housing 24 includes locking clutch 36 that is configured to releasably retain tack 30 if pin shank 34 is removably inserted into locking clutch 36 via aperture 26. Locking clutch 36 is a magnetic ball-clutch mechanism that includes cup 45 and ball retaining section 38 that movably positions a plurality of retaining balls 40 within cup 45. Ball retaining section 38 has tapered sides such that ball retaining section 38 can be movably positioned within cup 45 along axis 46. Axis 46 is positioned substantially through the center of aperture 26 and/or substantially orthogonal to housing mating surface 27. Cup 45 may be a metal cup that includes an aperture on the closed end of cup 45 that is distal the open end of cup 45 in which axis 46 passes through substantially the center of the aperture of cup 45 such that pin shank 34 may be removably inserted into cup 45. Cup 45 is shaped to position retaining balls 40 inward toward axis 46 when ball retaining section 38 is proximate housing mating surface, i.e., the angled sides of cup 45 position retaining balls 40 inward toward axis 46. Cup 45 may have a substantially bell or cone shape, i.e., tapered wall, among other shapes that position retaining balls 40 inward toward axis 46 if ball retaining section 38 is positioned proximate the housing mating surface by bias element 42. Cup 45 may be formed of a hardened metal. Each retaining ball 40 may have a diameter of 1.5 millimeters.

Locking clutch 36 also includes bias element 42 that provides a bias force to ball retaining section 38 such that ball retaining section 38 is movably positionable along axis 46. In this embodiment, locking clutch 36 includes three retaining balls 40 disposed on substantially the same plane in which the retaining balls 40 are configured to retain pin shank 34 if pin shank 34 is removably inserted into locking clutch 36, i.e., tag housing 24. Use of 1.5 millimeter balls allows the support of a 0.90 millimeter or narrower, e.g., 0.76 millimeter, pin shank diameter, while still providing a retaining force sufficient to retain the pin shank 34 in locking clutch 36 when an eighty pound pull force is applied to tack 30.

Figure 4:
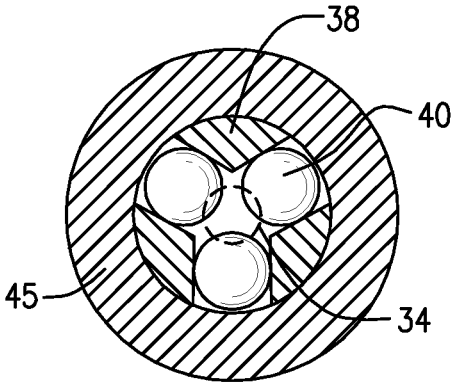
FIG. 4 illustrates a cross-section view of the locking mechanism of FIG. 3 constructed in accordance with the principles of the present invention.

Ball retaining section 38 may be made out of a magnetic material such that ball retaining section 38 can be positioned away from housing mating surface 27 by a magnetic detacher (not shown) that attracts ball retaining section 38 away from housing mating surface 27, thereby repositioning retaining balls 40 to allow retaining balls 40 to release pin shank 34. FIG. 4 is a cross-sectional view of locking clutch 36. In particular, locking clutch 36 includes three retaining balls 40 for releasably retaining pin shank 34 if pin shank is inserted into tag housing 24 via aperture 26.

Figure 5:
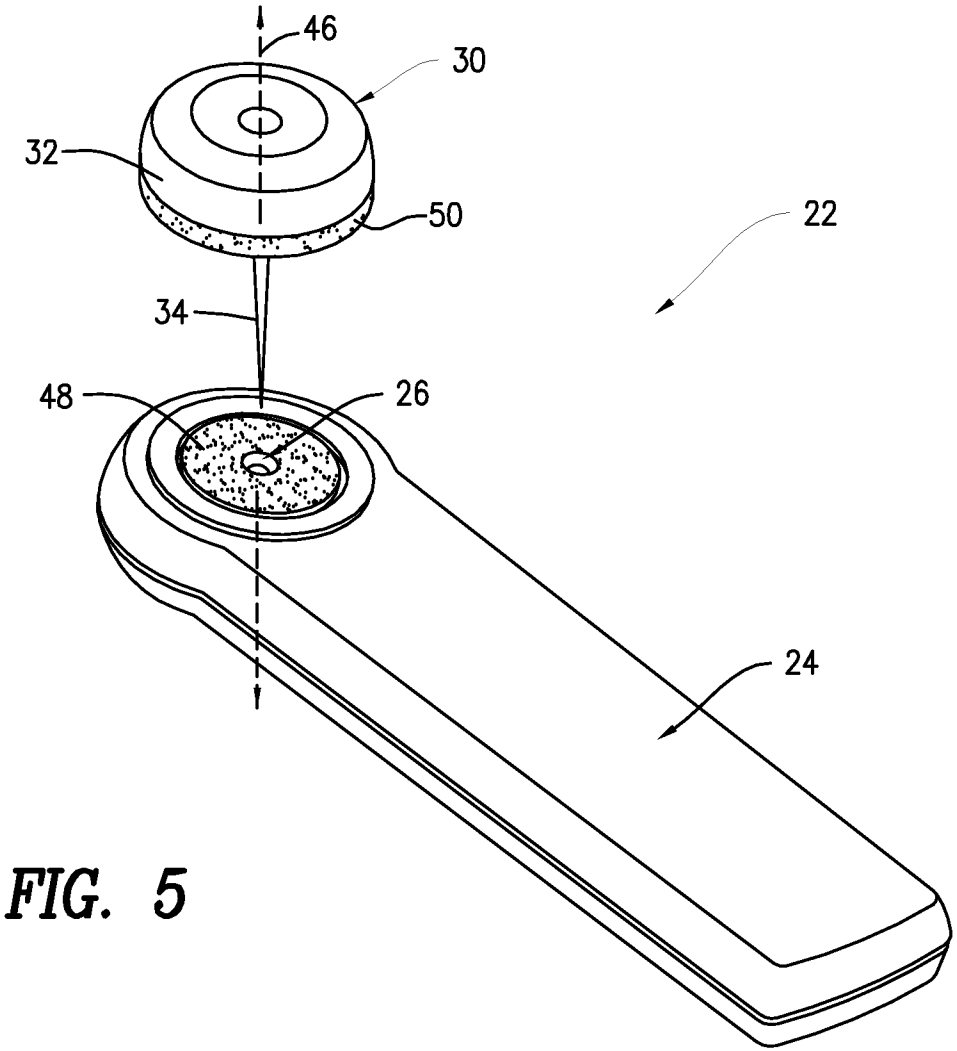
FIG. 5 illustrates a top perspective view of an embodiment of the security tag system having a non-slip material constructed in accordance with the principles of the present invention.

Referring to FIG. 5, there is illustrated another embodiment of tag 22. Elements of FIG. 5 substantially correspond to elements of FIG. 2 except that tag housing 24 and tack 30 include substantially non-slip material(s). In particular, housing mating surface 27 has housing material 48 affixed to or integrated with at least a portion of housing mating surface 27 in which housing material 48 is configured to reduce or substantially prevent article 20 from sliding in a direction perpendicular to axis 46 if article 20 is sandwiched between tag housing 24 and releasably retained tack 30. Tack mating surface 33 has tack material 50 adhered to at least a portion of tack mating surface 33 in which tack material 50 reduces or substantially prevents article 20 from sliding in a direction perpendicular to axis 46 if article 20 is sandwich between tag housing 24 and releasably retained tack 30. Housing material 48 and/or tack material 50 may be composed of the same or different substantially non-slip material such as rubber and/or rubber-like material(s). Housing material 48 and/or tack material 50 may be rigid material, soft material, elastic material or have other material properties. The combination of pin shank 34 having a diameter of 0.76 mm, housing material 48 and tack material 50 substantially reduces the damage caused by the pin hole such that tag 22 is usable with articles 20 made of delicate materials such as finely woven fabrics, silk, satin-woven, leather and sheer fabrics, among other materials that can be easily torn by a security tag pin shank during routine handling of article 20. In other words, tag 22 provides a tag that can be used for multiple types of articles 20 made from coarse to finely woven fabrics, among others, that creates less pin hole damage than existing systems, i.e., less noticeable pin hole damage, which is a key factor that consumers look for when purchasing article 20. Tapered pin shank 34 having a maximum diameter of 0.76 mm is equally applicable to other embodiments of the invention such as FIGS. 2-4 and 6-9. Further, tapered pin shank 34 illustrated in FIG. 5 can be replaced by pin 34 of FIG. 3 having a maximum diameter of 0.76 mm in which only the end of pin shank 34 is tapered. Other pin shapes having a maximum diameter of 0.76 mm that are retainable by locking clutch 36 may also be used.

Figure 6:
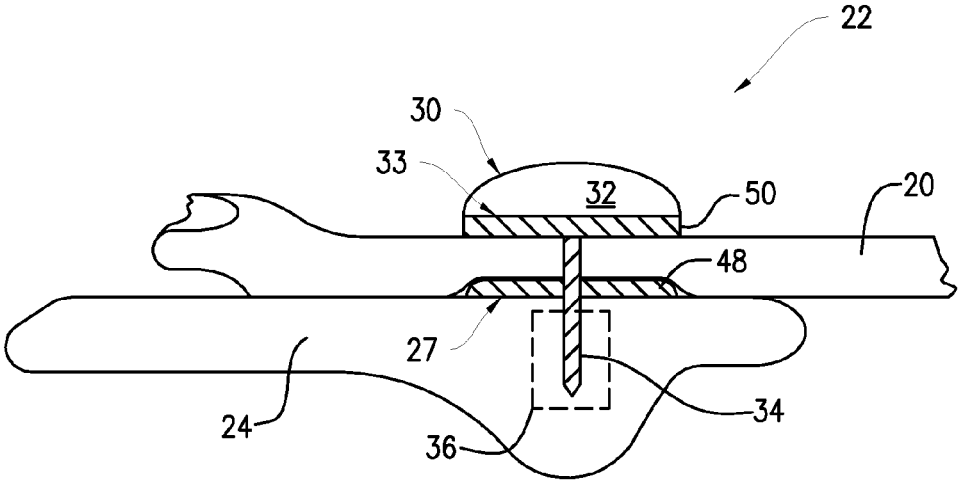
FIG. 6 illustrates a side cross-section view of the security tag system of FIG. 5 constructed in accordance with the principles of the present invention.

FIG. 6 illustrates a cross-section view of tag 22 of FIG. 5. Housing material 48 and tack material 50 are in direct contact with article 20 when pin shank 34 has been pierced through article 20 and is being releasably retained by locking clutch 36. In other embodiments, only one of housing material 48 and tack material 50 may be included. Alternatively, one of housing mating surface 27 and tack mating surface 33 may include substantially non-slip material while the other one of housing mating surface 27 and tack mating surface 33 includes a textured surface. In yet another embodiment, tack housing material 48 and/or tack material 50 be composed of a textured substantially non-slip material(s) such as to reduce or substantially prevent article 20 from sliding if pin shank 34 is pierced through article 20 and releasably retained by locking clutch 36. While these alternative embodiments are discussed with respect to FIG. 6, they are equally applicable to the other embodiments discussed herein.

Figure 7:
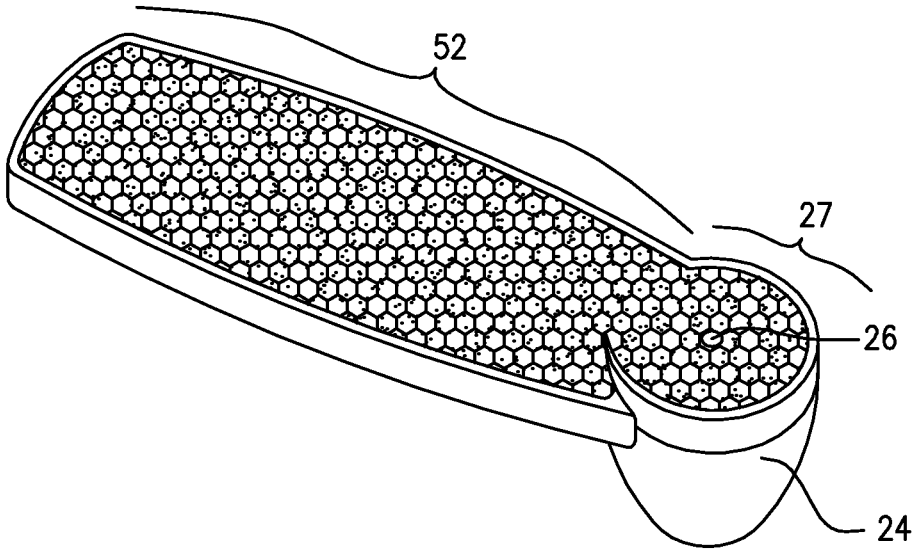
FIG. 7 illustrates a top perspective view of another embodiment of the security tag having a textured surface constructed in accordance with the principles of the present invention.

Referring to FIG. 7, there is illustrated another embodiment of tag housing 24 in which housing mating surface 27 and article mating surface 52 are textured. Housing mating surface 27 and article mating surface 52 may be textured during manufacturing by incorporating a textured area into the mold in which the resulting texture may be a "bumpy" surface or other textured surface that reduces or substantially prevents sliding of article 20 when pin shank 34 is pierced through article 20 and releasably retained by locking mechanism 36. The addition textured article mating surface 52 provides a greater textured total surface area that enhances the ability of the security tag to grip article 20, thereby further helping to prevent movement of article 20 which may otherwise result in article 20 tears.

Figure 8:
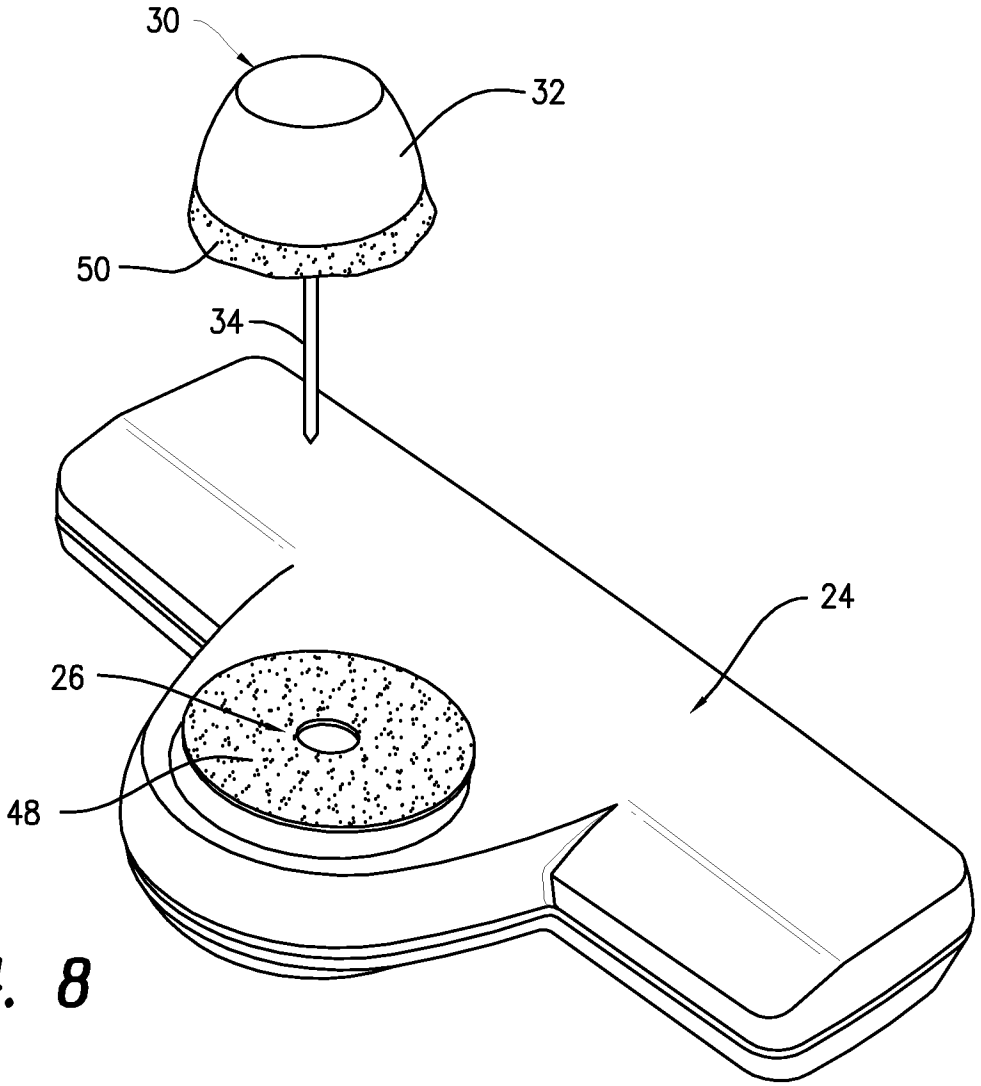
FIG. 8 illustrates a perspective view of another embodiment of the security tag system constructed in accordance with the principles of the present invention having a non-slip material.

FIG. 8 illustrates a perspective view of an alternative embodiment of tag housing 24 in which tag housing 24 has an elongated tag body. Aperture 26 is positioned substantially at a longitudinal midpoint of tag hosing 24 and allows pin shank 34 to be removably inserted into tag housing 24 such that locking clutch 36 (not shown) can releasably retain pin shank 34. Housing mating surface 27 may include housing material 48 similar to FIG. 2 or may be a textured surface as described in FIG. 7. Further tack mating surface 33 may include tack material 50 or may be a textured surface.

Figure 9:
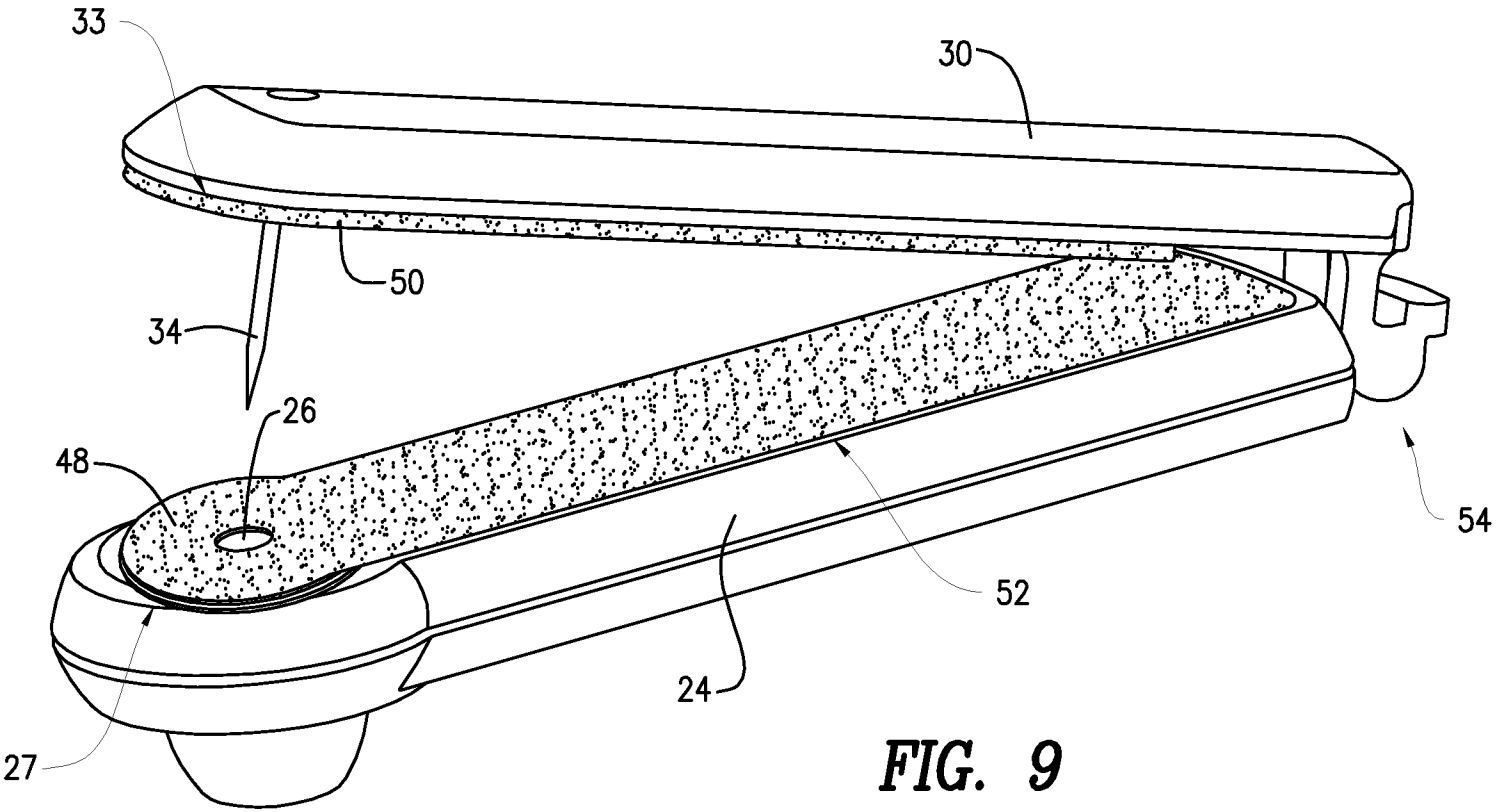
FIG. 9 illustrates a perspective of another embodiment of the security tag system having a hinged housing constructed in accordance with the principles of the present invention.

FIG. 9 illustrates another embodiment of tag 22 in which tag housing 24 and tack 30 are hingedly connected by hinge 54. Tack 30 is elongated substantially along tag housing 24 such that tack 30 and tag housing 24 substantially overlap. Housing mating surface 27 and article mating surface 52 may include housing material 48 adhered thereto in order to reduce or substantially prevent article 20 from sliding when pin shank 34 is pierced through article 20 and releasably retained by locking clutch 36. Tack mating surface 33 may include tack material 50 adhered thereto in order to reduce or substantially prevent article 20 from sliding when pin shank 34 is pierced through article 20 and releasably retained by locking clutch 36. This embodiment advantageously provides greater mating surface areas (27, 33, 52) that can be textured surface area and/or non-slip surface area in order to further enhance tag 22's ability to reduce or substantially prevent movement of article 20 around pin shank 34, thereby helping to prevent article 20 from tearing. Alternatively, one or both of housing material 48 and tack material 50 may be omitted.

Accordingly, the instant invention advantageously minimizes the amount of damage caused to article 20 by tack 30 when security tag 22 is removably attached to article 22. For example, the instant invention is able to minimize damage to article 20 by using groove-less pin 34 with a substantially reduced pin diameter, i.e., 0.76 mm, that can still be retained by ball-clutch mechanism 18 if an eighty pound pull force is applied to tack 30, thereby reducing the size of the pin hole in the protected article. Further, the instant invention advantageously reduces damage to article 20 by one or more mating surfaces having a textured and/or substantially non-slip surface. The textured and/or substantially non-slip surface(s) are able to help reduce movement of the portion of article 20 that is sandwiched by tag 22, thereby helping prevent the pin hole in article 20 from increase in size as often occurs with existing security tags during routine handling. Although the present invention is described with reference to the protection of delicate articles, it is understood that the security tag and tack arrangement described herein can be used to protect articles that are not "delicate".

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A security tag configured to releasably attach to an article, the security tag comprising:
- a tack, the tack including a tack head and a pin shank extending from the tack head, the pin shank having a maximum diameter less than 0.9 millimeters;
- a housing, the housing including:
  - an electronic article surveillance (EAS) element;
  - a clutch, the clutch configured to releasably retain the pin shank after insertion into the housing, the clutch retaining the pin shank if up to an eighty pound pull force is applied to the tack.

2. The security tag of claim 1, wherein the pin shank is a groove-less pin shank.

3. The security tag of claim 1, wherein the clutch is a magnetic ball-clutch, the magnetic ball clutch including a plurality of balls disposed on substantially the same plane, the plurality of balls configured to retain the pin shank when the pin shank in inserted into the housing.

4. The security tag of claim 1, wherein the pin shank has a maximum diameter of 0.76 millimeters.

5. A security tag configured to releasably attach to an article, the security tag comprising:
- a tack, the tack including a tack head and a pin shank extending from the tack head, the pin shank having a maximum diameter less than 0.9 millimeters;
- a housing, the housing including:
  - an electronic article surveillance (EAS) element;
  - a clutch, the clutch configured to releasably retain the pin shank after insertion into the housing, the clutch retaining the pin shank if up to an eighty pound pull force is applied to the tack; and
- at least one of the tack and the housing including a substantially non-slip material, the substantially non-slip material providing resistance to movement of a portion of the article that is located between the tack and housing when the tack is releasably retained by the clutch.

6. The security tag of claim 5, wherein both the tack and the housing include the substantially non-slip material.

7. A security tag configured to releasably attach to an article, the security tag comprising:
- a tack, the tack including a tack head and a pin shank extending from the tack head, the pin shank having a maximum diameter less than 0.9 millimeters;
- a housing, the housing including:
  - an electronic article surveillance (EAS) element;
  - a clutch, the clutch configured to releasably retain the pin shank after insertion into the housing, the clutch retaining the pin shank if up to an eighty pound pull force is applied to the tack; and
- the tack head including a tack mating surface and the housing including a housing mating surface substantially facing the tack mating surface when the pin shank is releasably retained by the clutch, at least one of the tack mating surface and housing mating surface including a substantially non-slip material.

8. The security tag of claim 7, wherein the substantially non-slip material provides a textured surface.

9. A security tag configured to releasably attach to an article, the security tag comprising:
- a tack, the tack including a tack head and a pin shank extending from the tack head, the pin shank having a maximum diameter less than 0.9 millimeters;
- a housing, the housing including:
  - an electronic article surveillance (EAS) element;
  - a clutch, the clutch configured to releasably retain the pin shank after insertion into the housing, the clutch retaining the pin shank if up to an eighty pound pull force is applied to the tack; and
- the tack head including a tack mating surface and the housing including a housing mating surface substantially facing the tack mating surface when the pin shank is releasably retained by the clutch, at least one of the tack mating surface and housing mating surface being a textured surface, the textured surface providing resistance to movement of a portion of the article that is located between the tack and the housing when the tack is releasably retained by the clutch mechanism.

10. A security tag configured to releasably attach to an article, the security tag comprising:
- a tack, the tack including:
  - a tack head, the tack head including a tack mating surface, at least a portion of the tack mating surface having at least one of a textured surface and a substantially non-slip surface; and a pin shank, the pin shank extending substantially orthogonally from the tack mating surface;

a housing, the housing including:

an electronic article surveillance (EAS) element;

a clutch, the clutch configured to releasably retain the pin shank; and a housing mating surface, the housing mating surface substantially facing the tack mating surface if the pin shank is releasably retained by the clutch.

11. The security tag of claim 10, wherein the substantially non-slip surface includes a substantially non-slip material, the substantially non-slip surface at least partially overlapping the portion of the housing mating surface if the pin shank is releasably retained by the clutch.

12. The security tag of claim 10, wherein the pin shank has a maximum diameter of less than 0.9 mm; and the clutch configured to retain the pin shank if up to an eighty pound pull force is applied to the tack.

13. The security tag of claim 10, wherein the pin shank is a groove-less pin shank.

14. The security tag of claim 10, wherein the non-slip surface includes a textured non-slip material.

15. The security tag of claim 10, wherein the pin shank has a maximum diameter of 0.76 millimeters.

16. A method of attaching a security tag to an article, the security tag including a tack and a housing, the tack having a tack head and a pin shank extending from the tack head, the pin shank having a maximum diameter of less than 0.9 millimeters, the housing including a ball clutch configured to releasably retain the pin shank if the pin shank is inserted into the housing, the housing further includes an electronic article surveillance (EAS) element configured to emit a detectable response if introduced to an interrogation signal, the method comprising the steps of:

a) inserting the pin shank through the article; and b) inserting the pin shank into the housing, the ball clutch configured to releasably retain the inserted pin shank if up to an eighty pound pull force is applied to the tack.

17. The method of claim 16, wherein the ball clutch includes a plurality of retaining balls disposed on substantially the same plane, the plurality of retaining balls configured to releasably retain the inserted pin shank.

18. A method of attaching a security tag to an article, the security tag including a tack and a housing, the tack having a tack head and a pin shank extending from the tack head, the pin shank having a maximum diameter of less than 0.9 millimeters, the housing including a ball clutch configured to releasably retain the pin shank if the pin shank is inserted into the housing, the housing further includes an electronic article surveillance (EAS) element configured to emit a detectable response if introduced to an interrogation signal, the method comprising the steps of:

a) inserting the pin shank through the article; and b) inserting the pin shank into the housing, the ball clutch configured to releasably retain the inserted pin shank if up to an eighty pound pull force is applied to the tack; and the tack including a tack mating surface and the housing including a housing mating surface substantially facing the tack mating surface when the pin shank is releasably retained by the magnetic ball clutch, at least one of the tack mating surface and housing mating surface including one of a substantially non-slip surface and a textured surface.

19. The method of claim 18, wherein the substantially non-slip surface is a textured non-slip surface configured to provide resistance to movement of a portion of the article that is located between the tack and housing when the tack is releasably retained by the ball clutch.

20. The method of claim 18, wherein the substantially non-slip surface includes at least a rubber material.

* * * * *